United States Patent [19]

Meschi

[11] Patent Number: 5,024,576

[45] Date of Patent: Jun. 18, 1991

[54] WORKING METHOD OF AN AUTOMATIC SERVICE TRUCK FOR MOVING SHEET PACKAGES

[75] Inventor: Luciano Meschi, Livorno, Italy

[73] Assignee: Industria Grafica Meschi S.r.l., Livorno, Italy

[21] Appl. No.: 359,350

[22] Filed: May 31, 1989

[30] Foreign Application Priority Data

Jun. 2, 1988 [IT] Italy ..... 20836 A/88

[51] Int. Cl.[5] ..... B65G 67/00; B60P 1/52

[52] U.S. Cl. ..... 414/786; 414/331; 414/400; 414/495; 414/572; 414/790.4; 414/791.1; 414/924

[58] Field of Search ..... 414/331, 389, 398, 400, 414/495, 572, 679, 786, 794.4, 790.4, 791.1, 923, 924, 926; 410/26, 27, 28.1, 28, 29.1, 29

[56] References Cited

U.S. PATENT DOCUMENTS

| | | | |
|---|---|---|---|
| 1,573,172 | 2/1926 | Laffey | 414/495 X |
| 2,687,814 | 8/1954 | Romick | 414/331 |
| 2,779,487 | 1/1957 | Harris | 414/923 X |
| 3,115,257 | 12/1963 | Kubik | 414/280 X |
| 3,637,095 | 1/1972 | Kampfer | 414/400 X |
| 3,741,413 | 6/1973 | Friel | 414/416 X |
| 4,232,986 | 11/1980 | Johnson | 414/495 X |
| 4,396,338 | 8/1983 | Applegate et al. | 414/331 |
| 4,506,455 | 3/1985 | Rossi | 414/331 X |
| 4,621,969 | 11/1986 | Berghäll et al. | 414/400 X |
| 4,826,384 | 5/1989 | Okura et al. | 414/331 X |

FOREIGN PATENT DOCUMENTS

| | | | |
|---|---|---|---|
| 62-218312 | 9/1987 | Japan | 414/398 |
| 2120608 | 12/1983 | United Kingdom | 414/495 |
| WO88/00538 | 1/1988 | World Int. Prop. O. | 414/495 |

*Primary Examiner*—Robert J. Spar
*Assistant Examiner*—Robert S. Katz
*Attorney, Agent, or Firm*—McAulay, Fisher, Nissen, Goldberg & Kiel

[57] ABSTRACT

Automatic service truck with a method for moving sheet packages comprising a base frame (22) surrounded by vertical upright struts (24–30) and housing a plurality of planes or trays (34, 36, 38) for receiving the sheet packages; the truck receives the packages, along first direction (x), moving along a second direction (y) perpendicular with respect to the first direction (x) with the help of wheels (50–54) and subsequently lifting the planes or trays (34, 36, 38) along a third direction (z) perpendicular with respect to both the first directions (x) and the second direction (y) to allow subsequent loading of sheet packages on the planes or trays.

2 Claims, 6 Drawing Sheets

Fig. 8
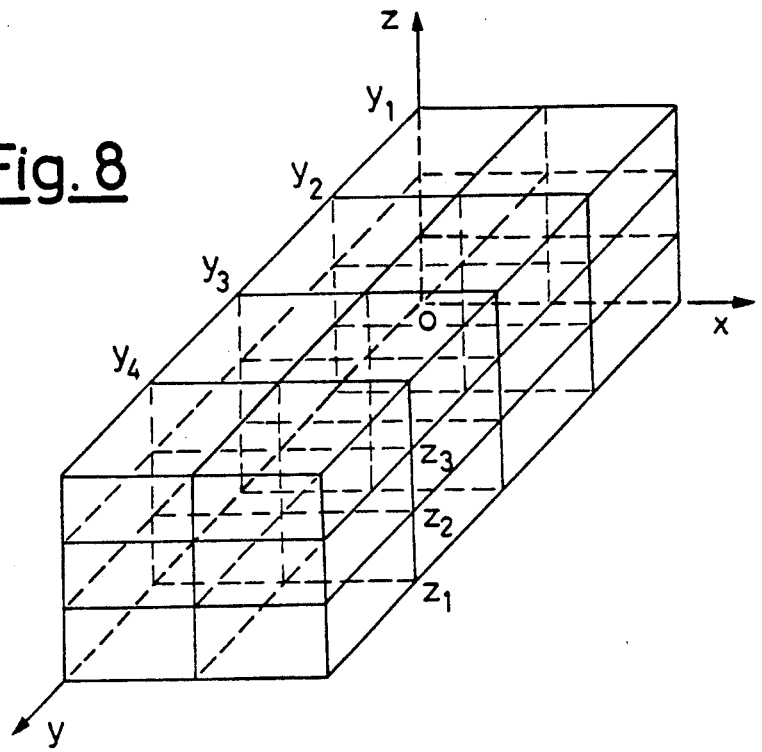
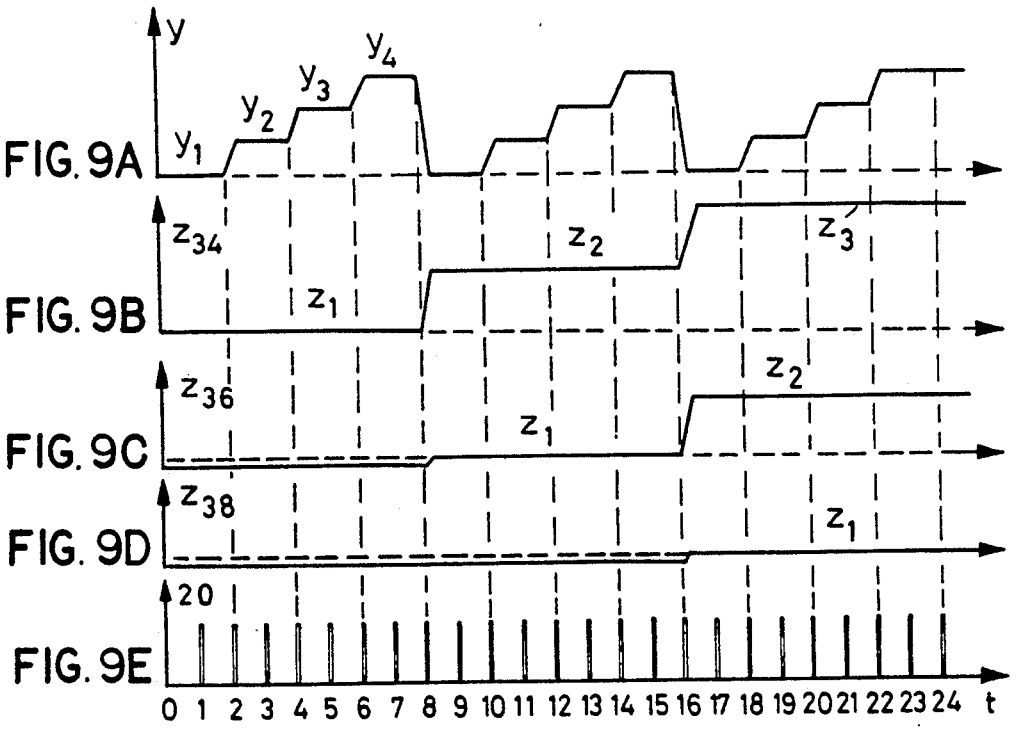

WORKING METHOD OF AN AUTOMATIC SERVICE TRUCK FOR MOVING SHEET PACKAGES

Present invention pertains to an automatic service truck used to move sheet packages from a machine discharging said packages to storage places of the machines using said sheets.

In the practice of medium or large data processing centers there is many times the need of moving sheet packages which are discharged by a machine to storage or filing places or to other machines performing further processing to said packages.

For example, a fast printing machine could discharge sheet packages, in the form of an accordion folded paper web, which should be further divided in groups of limited sheet number containing messages to be sorted.

In such a case, the fast printer, for example a laser printer, should be followed by a cutting, folding and message packaging or envelopping machine, as for example foldable and self adhesive sheets, forming the typical bills for paying goods or services such as, electric power, gas, phone services and the like.

Many times, it happens that in a data processing center there are many fast printers, served just by one cutting, folding and packaging machine. In such a case, it is necessary to carry the folded sheet packages coming out of the printer, to the above mentioned machine for executing the next working. The simplest method to execute said carriage is to collect a printed paper package and carry it to the other machine. If said package is relatively light and if it is formed not very often, a simple hand-carriage of single packages can be sufficient. However it can be enough that said package is rather heavy to have problems of difficult carriage and danger of sheet deterioration, because should, for example, some sheet be wrinkled, serious problems in the next working of the packaging or envoloping machine can arise.

A simple and practical solution for carrying said packages should be to provide a single planar truck at the output of the printer to collect the package emitted by the same and carry it to be next packaging machine. This solution can work well enough if the printer is not so fast to ask, for the preparation of a sheet package, times shorter of the time asked to carry every package from the printer to the packaging machine, needing to stop the printer during the carriage time.

Further, many times it happens that the work asked to be performed by a printer without any interruption, is so large that the output of the printer cannot be contained just in one package and thus it is necessary to use a truck containing more than one package, providing care to move time by time said collecting truck at every package emission from the printer to orderly arrange said packages on the truck. In such a case a person must be charged to follow said package emission and provide to place them in due order on the truck. This kind of charge suffers from the drawback of being particularly tedious and not to tolerate inattentions from the charged personnel, introducing some confusion in the arrangement of the packages on the truck.

Another problem which could happen is that just one truck cannot be large enough for containing the minimum number of printed sheet packages before having the opportunity for stopping the printer and thus it arises the need of using multiple plane trucks compelling to complicate the controls required from the charged personnel and asking for a higher care. It arises the need of having a service truck performing automatically this duty, by orderly arranging the packages on the truck, possibly in sequence, on a plurality of planes and eventually indicating a complete loading of the truck and possibly stopping the printer at a complete load to allow the package carriage to the packaging machine.

Thus, a purpose of the present invention is to provide such an automatic service truck, to be temporarily positioned in a service space existing around said machine, and particularly at the output of the same, for receiving sheet packages coming out from the machine, such as a fast printer, arranging them according to a desired order on a plurality of planes or trays fillable in sequence and once the load has been completed, providing to alert the controlling personnel and possibly, properly intervening on connected machines such as a printer and the subsequent packing machine.

Said ordered arrangement of packages and said subsequent loading of truck planes can be controled by the flowing of discharged packages or by a program of a processor external to the truck.

Briefly stated, according to the present invention, an automatic service truck for moving or carry sheet packages is loaded with a plurality of said packages, relatively placed side by side and superimposed in many layers, according to a method characterized in that said packages are loaded side by side to completely a first fill plane in said truck, then said plane is lifted to have a second available plane which can also be loaded with said side by side packages to be completely filled, then said two completely loaded planes are lifted together for having a third available plane to be completely loaded and so on until there are planes to be loaded.

Particularly, said method is characterized in that once all the available planes have been loaded, the truck is released to allow the carriage of the loaded packages to a destination place.

Further, according to the said method, when the load is complete, the machine supplying the packages to said truck, is stopped.

More particularly, according to said method in which said truck is associated with cartesian axes, having its origin in a given point on said truck, the packages to be loaded on said truck are arranged side by side along a first axis (x) whith the first package being adjacent to the origin of the cartesian axis tern, a second package being immediately near the first one, and so on, until the available space along said first axis (x) is completely filled, then the truck is moved along a second axis (y) perpendicular with respect to the said first axis, through a space large enough for receiving a second package row which is side by side arranged along said first axis (x) until the space along said first axis (x) is completely filled, after that the truck is further moved along said axis (y) for receiving a third package row to be arranged side by side along said first axis (x), said truck movement along that second axis (y) prosecuting until there is available room for side by side arranged package rows along said first axis (x) and then, once a first plane delimited by said first axis (x) and said second axis (y) is completely filled, said first plane is moved along a third axis (z) perpendicular to said first two axes (x, y) for example by means of a lifting for having available a second plane, delimited by said first and second axes (x, y) to be filled by sheet packages according to the process used to fill said first plane then said first and second planes are moved together along said third axis (z) for having a third available plane to be filled with sheet packages exactly as the first and second planes, and so on, until room remains available along said third axes (z) perpendicular to the first two axis (x, y), the package collection of said truck ending when the room along said third axis (z) is completely filled. This is merely set forth as an example, and it should be noted that the packages can be any selected number deep in the X direction, etc., and the use of any suitable configuration is obviously usable with this invention.

According to present invention, said automatic service truck for moving or carrying sheet packages, being said truck arranged near a machine, such as a fast printer, subsequentely supplying sheet packages by means of a conveyor, being said machine provided with means for signalling the transit of any sheet package, is characterized in that said truck, positioned in a service space existing around said machine, and particularly at the output of the same, is costituted by a base frame, provided with a base plate, from which extend vertical upright struts provided with inside faced slots and housing among them stacked planes or trays for receiving sheet packages coming from the conveyor, said base frame being assembled on wheels allowing movement according to a direction (y) perpendicular with respect to the sheet package arrival direction and said planes or trays being liftable in sequence along said vertical struts for housing a plurality of sheet package rows arranged according to the above indicated procedures.

Further said automatic service truck is characterized in that the movements of said truck are provided by just an electric synchronous or stepping motor actuating a gear group providing movement both to said wheels, to allow a movement of the truck along an axis (y) perpendicular with respect to the arrival direction of the sheet packages, and to means moving the planes or trays according to a direction perpendicular with respect to the first two axes (x, y) to allow a subsequent filling, followed by lifting, of every plane or tray till the completion of the containing and carrying capacity of said truck.

In particular, said automatic service truck is characterized in that said driving group is formed by a first portion for transmitting movement to the wheels of the truck and by a second portion containing an electromagnetically controlled clutch and a sprocket actuating, through a chain, sprockets of vertical shafts positioned inside the vertical struts for actuating lifting mechanism of said trays.

More particularly, said automatic service truck is characterized in that within every vertical strut a vertical shaft is provided on the top with a bevel gear wheel meshing with a corresponding gear wheel connected to a sprocket, having horizontal axis, trailing an open chain connected at a side to brackets connected with respective planes or trays, said chain being open because, when said three planes or trays are completely lowered, two respective chain stretches connecting said trays are completely collapsed and folded occupying the smallest room the possible and are subsequently extended for causing a subsequent lifting of said trays beginning from the highest one.

Further and preferably said automatic service truck is characterized in that the open chain is kept extended in its descending stretch by a counterweight favouring its movement and balancing the weight of the trays.

Also more preferably, said automatic service truck is characterized in that when a first tray has been completely loaded, the first tray is carried by said open chain from a first loading position to a second position at such a height to load sheet packages on a second tray, which is concurrently lifted from a rest position to a loading position at the level of the conveyor of the served machine and, when said second tray is completely loaded, the second tray is carried by said chain from said first loading position to said second loading position, while said first tray is carried to a third still more elevated position and said third tray is lifted from its rest position to the loading position at the level of said conveyor.

Particularly, said automatic service truck in which the subsequent liftings of the trays are provided by the open chain, is characterized in that the lifting of the second tray from the rest position to the loading position is provided by beginning to pull the first stretch of the collapsed chain and the subsequent lifting of the second and third tray from the loading position to the lifted position and from the rest position to the load position, respectively, are provided by the tension of both the pulling of first chain stretch and the beginning to pull a second chain stretch.

According to an alternate embodiment of the present invention said automatic service truck is characterized in that said driving group is formed by a first portion transmitting movement to said wheels and second portion for moving planes or trays, said second portion containing an electromagnetically controlled clutch and two axle-shafts driving, through bevel gear wheels, corresponding bevel gear wheels of shafts carring sprockets engaging closed chains, turnable around sprockets housed at the top of said struts, provided with pins increasingly extending, engageable with brackets drecreasingly estending from said trays so that the first pin can engage just the bracket of the first tray and avoid the brackets of the other two trays, the second pin engages just the bracket of the second tray and avoid the bracket of the third tray and the third pin engages the bracket of the third tray.

Particularly, said automatic service truck is characterized in that said pins extending from the chain engage in sequence the trays so that, when the first tray has been completely loaded with sheet packages, it is lifted from a loading position to a first elevated position and concurrently the second tray is lifted to the loading position at the level of the conveyor of said machine, when said second tray has been completely loaded with sheet packages, it is lifted from said loading position to said first elevated position; while said first tray is lifted to a second elevated position and said third tray is lifted to said loading position.

Within said automatic service truck, in which the translating movement of the truck and the lifting movements of the trays are controlled by pulses coming from a sheet package transit detector on a conveyor, said pulses are sent to an electronic circuit counting the sheet packages, providing a movement of the truck along an axis (y) perpendicular with respect to the arrival direction of the packages every first preset number of packages loading a plane or tray of the truck in said arrival direction, returns the truck along said axis (y) perpendicular to the arrival direction of the packages and lifting the plane along another axis (z) perpendicular to said said two preceeding axes when the package number is such to have completely loaded said truck plane or tray, repeating the operation along said two axes (y, z) until all the planes of the trays of the truck are completely loaded after that emitting an alerting signal indicating the complete loading of the truck.

Particularly, in said automatic service truck the electronic circuit is characterized in that at the complete loading, further to emit said alerting signal, it provides also to deactuate the machine providing said truck with sheet packages.

More particularly, said automatic service truck is characterized in that said electronic circuit is controlled by said package dectector is formed by a pulse counter counting the pulses coming from the package detector, by a numerical comparator, comparing the numbers coming from said counter with numbers provided by a keyboard, by a display assembly displaying on a first display window the number of packages counted by said counter, on a second display window the number preset by the keyboard, and on a signalling device the coincidence of the package number counted by the counter with the number preset by the keyboard, said numerical comparator having a plurality of outputs emitting signals for actuating respectively said electric motor, said electromagnetic clutch, an unlatching device to allow the descent of the planes or trays, said device signalling the coincidence of the package number with the number preset by the keyboard, a counter reset and possible deactuations of external machines.

Further, said automatic service truck is characterized in that said electronic circuit contains a further connectionc among said keyboard, said counter, said signalling device and said deactuating means for external machines in order to interrupt willingly a truck loading.

Eventually said service truck is characterized in that said electronic circuit is provided with a further connection with external processing centers for allowing an external control of the same electronic circuit.

The features and the advantages of the present invention will be better apreciated by the reading of the following detailed description of embodiments thereof, provided with the enclosed drawing, in which.

Figure 6:
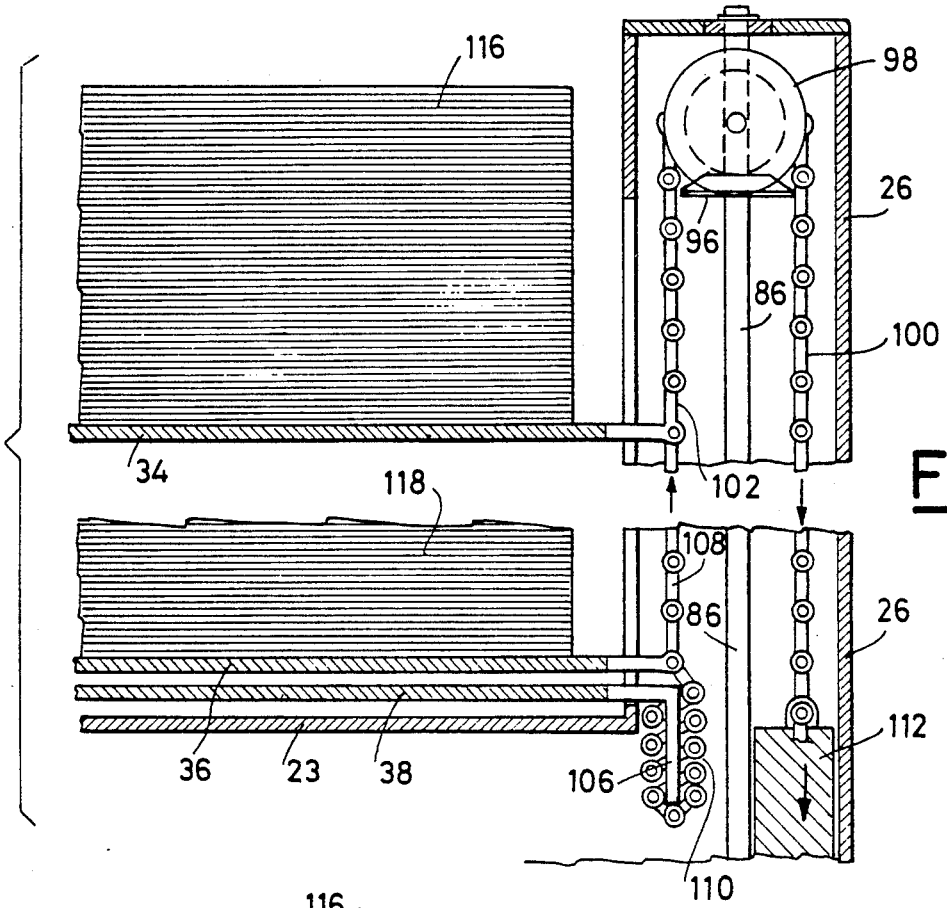
Figure 7:
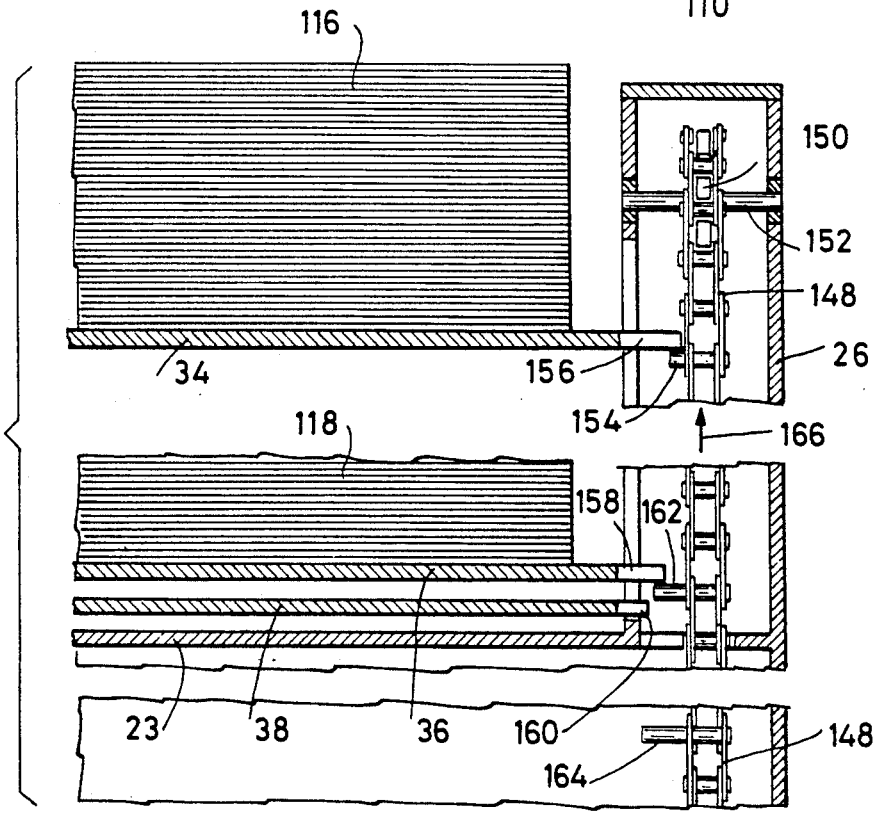
Figure 10:
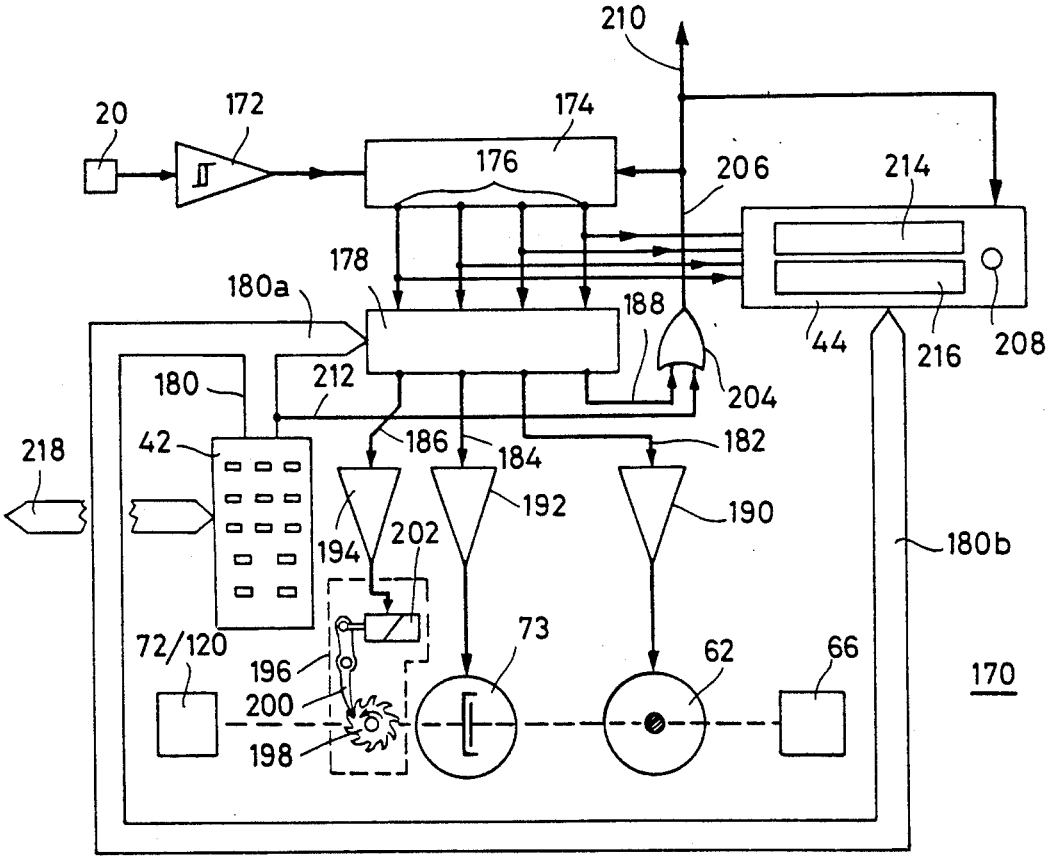

FIG. 6 depictes, in a simplified way, a first example of mechanism for lifting planes or trays of the truck according to the present invention;

FIG. 7 depictes, in a simplified way, a second example of mechanism for lifting planes or trays of the truck according to present invention;

FIG. 8 is a depiction on orthogonal cartesian coordinates or axes of an example of sheet package arrangement embodied on one of the automatic trucks according to present invention;

FIG. 9 illustrates time plots depicting the movements of the truck, according to present invention, and planes or trays thereof;

FIG. 10 depictes a simplified block diagram of an electronic circuit providing the working of the truck according to present invention.

Referring to FIG. 1, 2, 3 and 6, it is seen that a first example of the present invention consists of a truck 10 to be arranged at the output of a machine 12, such as a high speed printer, imputting or discharging to the truck 10 sheet packages formed on an output conveyor 14, the trail of said packages to the truck 10 being detected by a sensor, for example an optical sensor consisting of a lamp 16 emitting a light beam 18 collimated to a photodetector 20.

Figure 1:
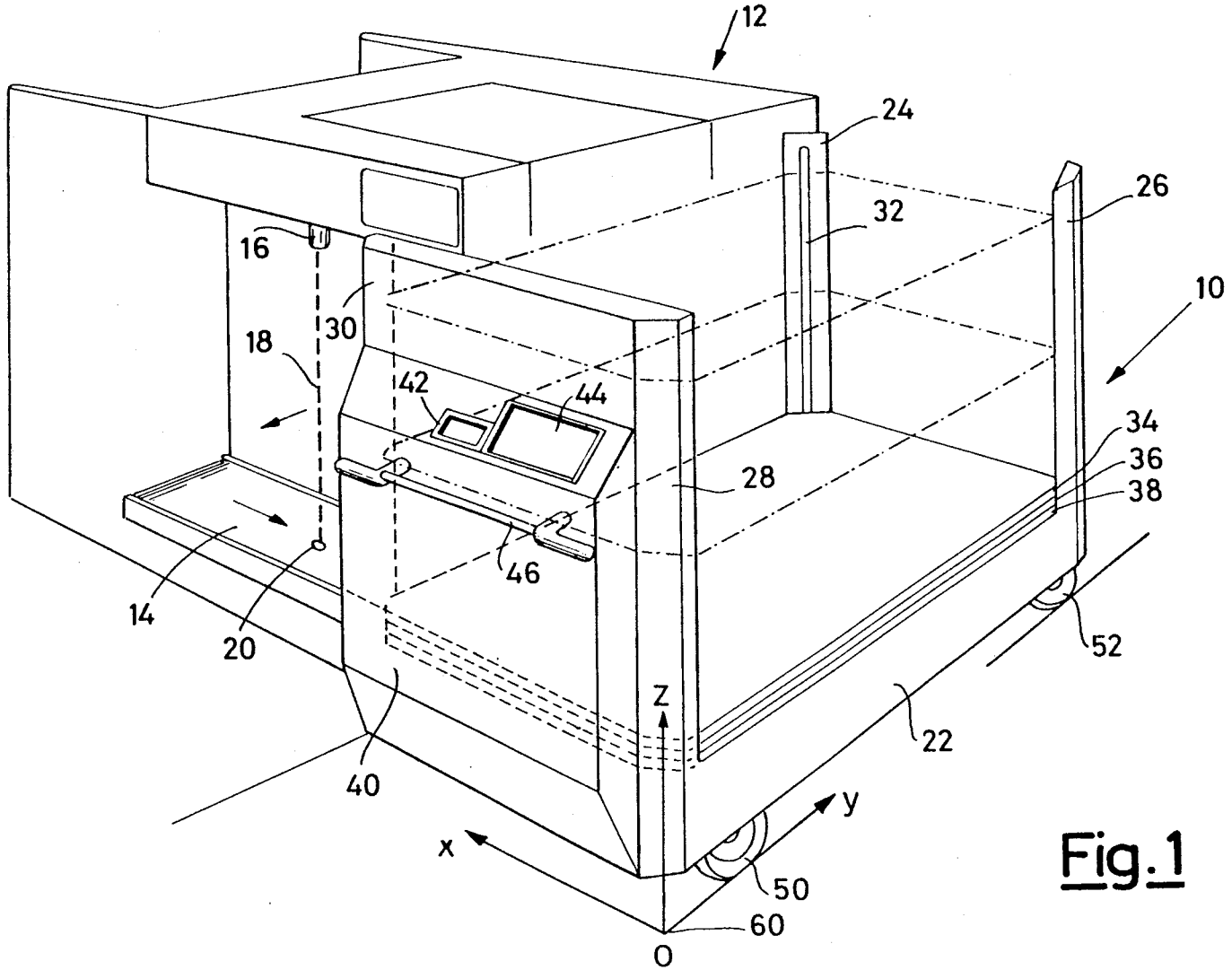
FIG. 1 is a perspective view of an automatic truck according to present invention connected to the output of a machine delivering sheet packages, such as a high speed printer.
Figure 3:
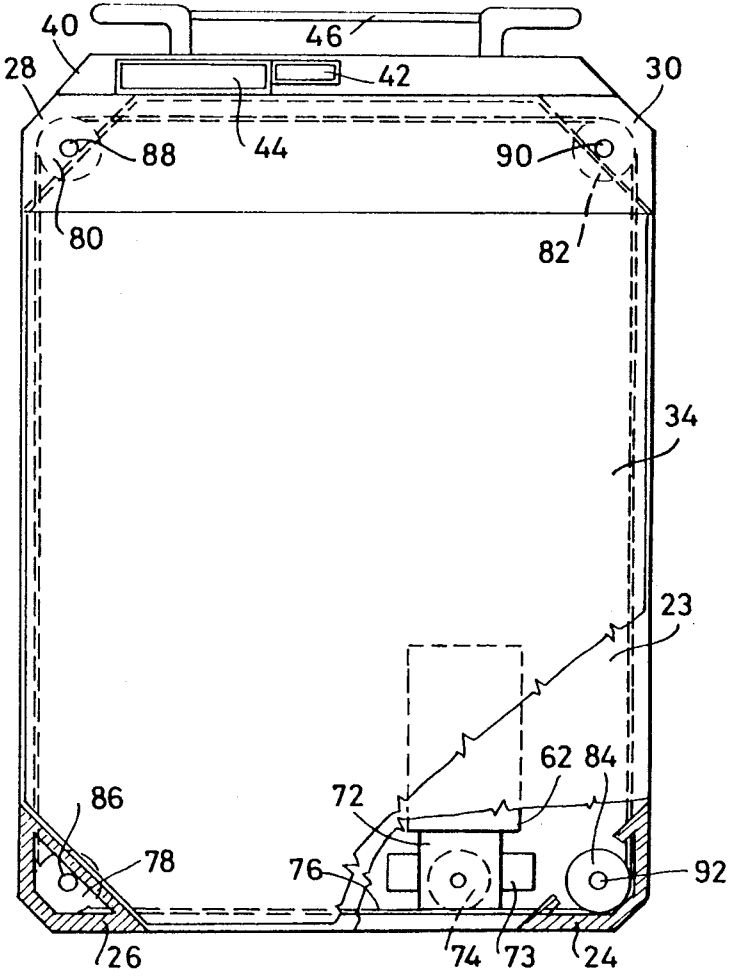
FIG. 3 is a top, partially broken, view of the same first example of truck.
Figure 2:
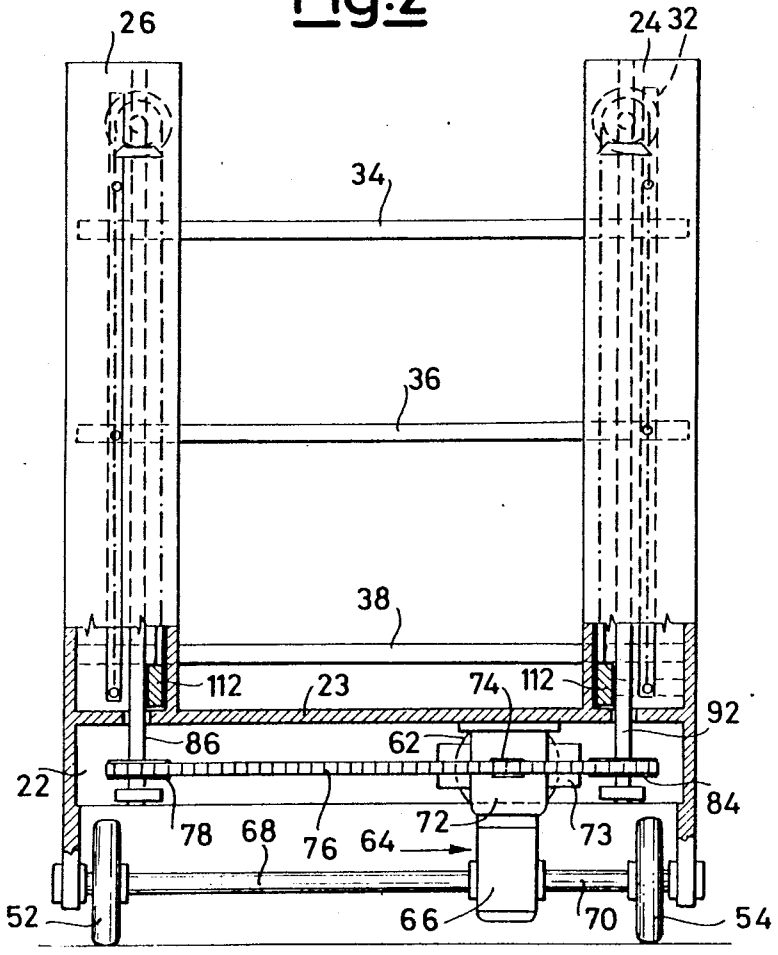
FIG. 2 is a lateral elevation, partially broken, view of a first example of truck depicted in FIG. 1.

The automatic truck 10 is formed by a base frame 22, provided with a base plane 23 from which extend four vertical upright struts 24, 26, 28 and 30 provided with longitudinal guide slots, such as the slot 32 visible in FIGS. 1 and 2, wherein enter brackets coming out of planes or trays 34, 36 and 38.

Said truck 10 is provided with a front board 40, containing handling and controlling circuit for moving the truck and displaying the position of the packages loaded thereon, a keyboard 42 and a display 44 allowing said handling and said displaying.

A handle 46 secured to the board 40 and then to the struts 28 and 30 of the truck, allows hand movements of the trucks which can be necessary when said truck is completely loaded with packages or it is desirable, for some reason, to interrupt the loading of a truck.

The truck 10 is mounted on wheels 50, 52, 54 (not all visible) allowing a movement in two senses along a "y" axis of a cartesian tern whose origin 60 is conventionally set at the foot of the vertical front right side of the truck.

The movement of the truck 10 along the "y" axis is provided by a actuating group comprising a synchronous or stepping electric motor 62 and driving group 64 divided into two portion: a portion 66 driving the truck wheels through two axle-shafts 68 and 70 and portion 72, for moving planes or trays 34, 36 and 38, containing a clutch or similar electromagnetically controlled connecting device 73 and a sprocket 74 driving, through a chain 76, sprockets 78, 80, 82 and 84 of vertical shafts 86, 88, 90 and 92 housed into the struts 24, 26, 28 and 30 for actuating the moving mechanism of said trays.

Particularly, looking at a vertical strut, for example the strut 26 depicted in detail in FIG. 6, it is seen that the vertical shaft 86 is provided, on the top, with a bevel gear wheel 96 meshing with a corresponding gear wheel connected to a sprocket 98, having a horizontal axis, driving an open chain 100 connected at a side to brackets 102, 104, and 106 firmly connected with the planes or trays 34, 36 and 38. Said chain 100 is open because when the three trays 36, 36 and 38 are completely lowered, two chain stretches 108 and 110, respectively, connecting the trays must be collapsed and folded in order to occupy minimum the possible room and are stretched in sequence for causing the subsequent lifting of said trays, beginning from the tray 34.

The chain 100 is maintained stretched on its descending portion by a counter-weight 112 which helps the movement of the same and in part balances the weight of the trays 34, 36 and 38.

As particularly depicted in FIG. 6, the trays 34 and 36 have been already loaded with respective sheet packages 116 and 118, while the tray 38 is still to be loaded. The tray 34 has been lifted in a second position to allow to introduce the package 118 on the tray 36, the tray 36 has been lifted from a rest position to a first or loading position at the level of the conveyor 14 (visible in FIG. 1) and the tray 38 is still to be lifted and thus lays in the lowest position adjacent to the base plane 23.

From FIG. 6 it is understood that when the tray 34 is lifted from the first loading position, to the second position, the chain stretch 108, between the bracket 102 of the tray 34 and the bracket 104 of the tray 36, is stretched lifting said tray from the rest position to said first or loading position at the level of the conveyor 14 of FIG. 1. Likely, once the tray 36 has been completely loaded, this should be lifted in a second position, while the tray 34 should go in a third position and the chain stretch 110 would be stretched, lifting the tray 38 from the rest position to the first or loading position at level of conveyor 14 of FIG. 1.

Referring to FIGS. 1, 4, 5 and 7 depicting another truck example according to the present invention, it is seen that, likely that it happens in the first embodiment, the truck 10 is at the output of a high speed printer 12 loading on said truck 10 sheet packages. This truck is similar to that of the first example for what regards the movement along the "y" axis, while it differs in the lifting sistem of the trays 34, 36 and 38.

As in the first example, the movement of the trucks 10 along the "y" axis is provided by an actuating group formed by a drive group 65 divided in two portions: a portion 66 driving the wheels of the truck through two axle-safts 68 and 70 and a position 120, for moving planes or trays 34, 36 and 38, containing connected devices, controlled for example electromagnetically, for moving two axle shafts 122 and 124 driving bevel gears 126, 130 and 128, 132 having the duty of moving two shafts 134 and 136 carrying two sprocket pairs 138, 142 and 140, 144 respectively, for driving chains having the duty of lifting said trays 34, 36 and 38, as better herebelow depicted in FIG. 7.

Figure 5:
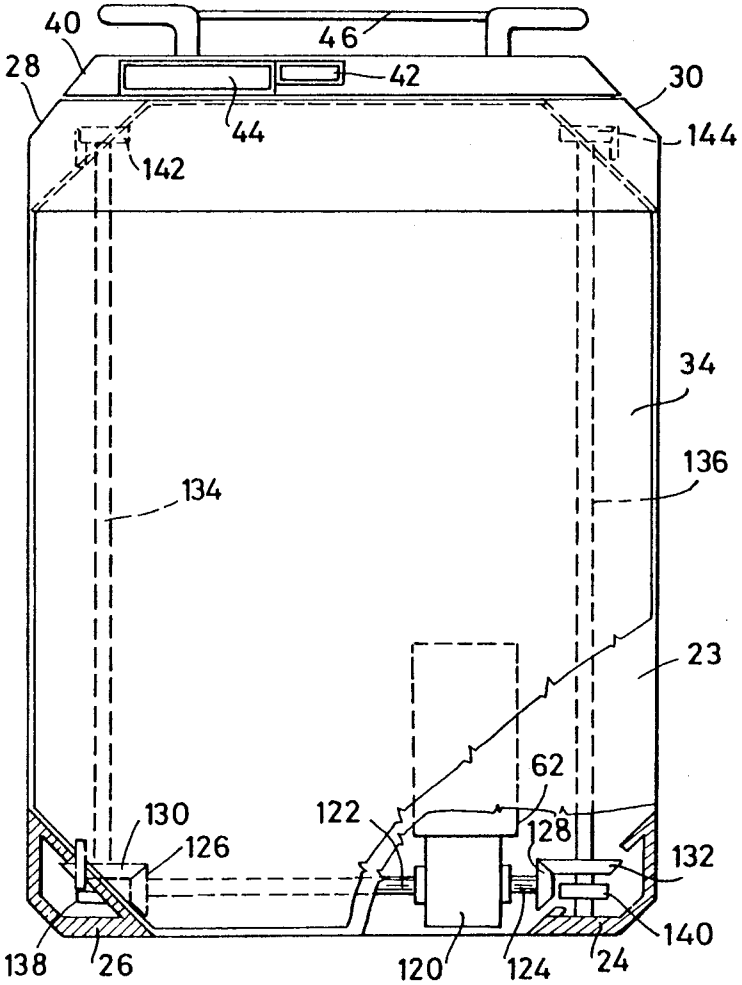
FIG. 5 is a top, partially broken, view of the same second example of truck.
Figure 4:
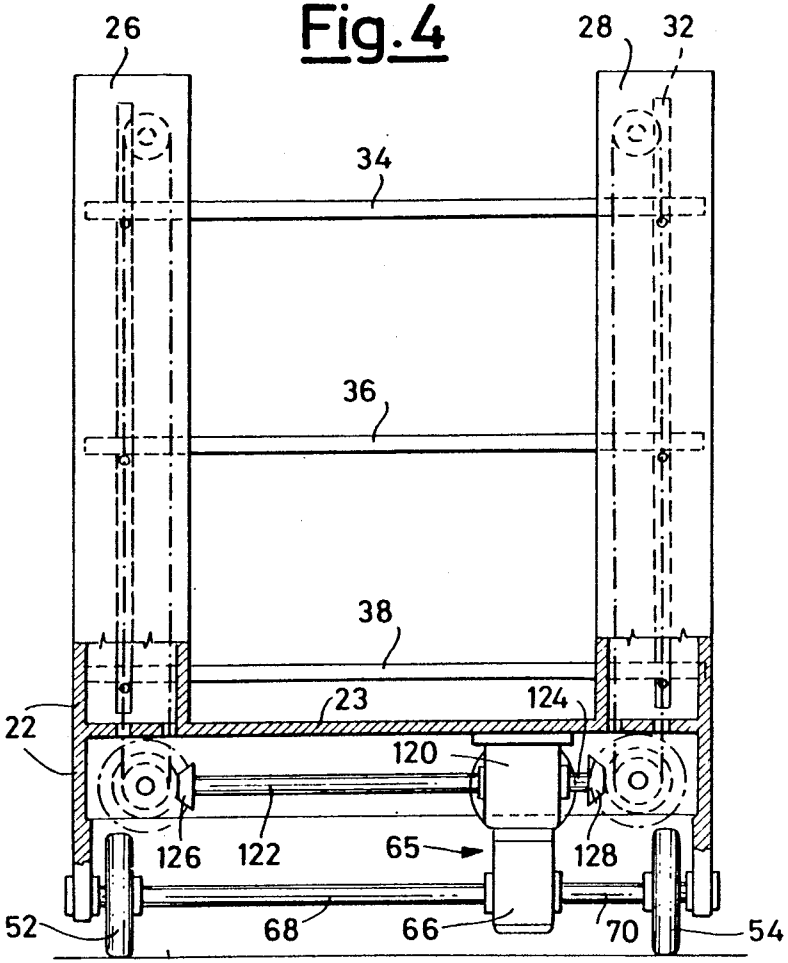
FIG. 4 is a lateral elevation, partially broken, view of a second example of the same truck depicted in FIG. 1.

Particularly referring to FIG. 7, depicting the inside of one of the vertical struts, as for example the strut 26, it is seen that a closed chain 148, for example driven by the lower sprocket 138, shown in FIG. 5, rises into the strut 26, turning around an idle sprocket 150, housed near the top of the strut 26 and turnable by means of a pivot 152. Said chain 148 carries at preset points extended pins or brackets engageable with brackets extended from the trays 34, 36 and 38 for causing their subsequent lifting.

Still referring to FIG. 7, it is seen that a first pin 154 extends just enough for engaging a bracket 156 coming out the tray 34, while it avoids the brackets 158 and 160, respectively coming out the trays 36 and 38, a second pin 162 extends just enough for engaging the bracket 158 of the tray 36 and avoiding the bracket 160 of the tray 38 and the third pin 164 extends enough for engaging the bracket 160 of the tray 38, thus causing the subsequent lifting of the three trays 34, 36 and 38. The distance among the pins 154, 162 and 164 is such to allow the lifting of a tray at one of the higher levels and the lifting of the subsequent tray to the charging level in a way similar to what happens with the lifting mechanism depicted in FIG. 6.

In fact by moving the chain 148 according to the direction of the arrow 166, makes the pin 154 contacting with the bracket 156 of the trays 34 avoiding the brackets 158 and 160 of the trays 36 and 38 respectively, which are not extended enough for engaging said pin 154 and lifting the tray 34 carrying it from the loading position, in which it receives sheet packages, to a second position raised enough to allow the subsequent coming packages to be loaded on the subsequent tray 36.

When the tray 34, loaded with the package 116, reaches said second position, the tray 36, having its bracket 158 engaged by the pin 162, is lifted from the rest position to a lightly raised position at the level of the conveyor 14 (see FIGS. 1) for allowing to load the packages 118 without any problem.

Likely, after the tray 36 has been completely loaded with packages, such as the package 118, it is raised by the movement of the chain 148 in the direction of the arrow 166 going from the loading position, shown in FIG. 7, to the higher position before occupied by the tray 34, which is further lifted. As the tray 36 has come to the higher position, the tray 38 having the bracket 160 engaged by the pin 164, is lifted from its rest position to the loading position, for going to conveyor 14 level of FIG. 1 in order to allow a loading operation without problems.

The loading of sheet packages on as many planes as are the trays on the automatic truck, according to present invention, happens in accordance with the depiction in FIG. 8.

The empty truck 10 is positioned near the machine 12 in the position depicted in FIG. 1, such as the foot of the front right side 28. Then the first sheet package, which is loaded on the truck, comes to the right front corner on the highest tray 34. Let us suppose that the packages have such sizes to be loaded in groups of two positioned side by side along the axis "x" of the tern or origin 60, then, if it is supposed to load the packages provided to the truck in a space determined by said cartesian axis tern, it will be found that the first package is positioned adjacent the origin on the plane x, y, the second package is lateral with respect to the first package to cover all the permitted room along the axis x. Once the permitted room along the axis x is completely used, the truck 10 is advanced along the y axis for loading a second row of two packages. The same procedure can be repeated a third or fourth time until the whole plane x, y on a tray has been loaded. At this time the tray is lifted along the z axis to such a height to allow the loading on the subsequent tray 36 of a succession of packages according to the same procedure used for the first tray 34 and, to this purpose, the truck 10 is withdrawn along the y axis until the foot of the strut 28 coincides with the origin of the tern 60 of cartesian axes.

It is continued to load the tray 36 with the same procedure for the tray 34 to complete said loading. Once such a loading has been completed, the tray 36 is lifted, together with the tray 34 for having the third tray 38 available and, to this purpose, truck 10 is withdrown along the axis y until the foot of the strut 28 coincides with the origin of the cartesian axis term 60.

It is proceeded to load the last available tray 38 according to the same procedure used for the preceeding trays 34 and 36. In conclusion the package assembly on the truck 10 takes the configuration depicted in FIG. 8. A first group of two packages is arranged along the x axis at distance $Y_1$ from the origin of the cartesian axis tern, followed by a second group at a distance $Y_2$, by a third group at a distance $Y_3$ and by a fourth group at a distance $Y_4$. Once the allowable number of packages on a tray has been completed, said tray is lifted along the axis z, going from altitude $Z_1$ to altitude $Z_2$ and the truck is withdrawn along the y axis, such as the next group of the two packages comes on the next tray 36 adjacent the x axix at a distance $Y_1$.

The procedure goes on arranging packages at distances $Y_2$, $Y_3$, and $Y_4$, completing the tray 36 which lastly is lifted going from altitude $Z_1$ to altitude $Z_2$, while the tray 34 is further lifted for going from altitude $Z_2$ to altitude $Z_3$.

During the lifting of the trays the truck 10 comes back along the y axis to the origin for beginning the loading of the last tray 38 at the same point of the preceeding trays.

The loading of the last tray 38 continues in accordance with the same procedure of the first and second trays 34 and 36 until its completion, at which time the truck 10 stops the loading procedure and, possibly, also the working of the machine 12 releasing the truck 10 to allow the carriage to the desired adress of the packages loaded on the same. Said completion is usually made evident by optical and/or acustical signals and by release of the truck 10 from the machine 12. The truck 10 movements can be connected with the arrival of the sheet packages counted for example by the lamp 16 and photodetector 20 assembly emitting a pulse signal for every transit of a package on the conveyor 14.

As indicated in FIG. 9, in the lower plot, the transit of a complete package on the conveyor 14 is represented by a pulse, numbered from 1 to 24, along the time axis. The arrival of the number 2 pulse shiftes the truck from the position $Y_1$ to the position $Y_2$, the arrival of the pulse number 4 shiftes the truck from the position $Y_2$ to the position $Y_3$, the arrival of the pulse number 8, further returns the truck from the position $Y_4$ to the position $Y_1$. The same pulse number 8, further to return the truck in the position $Y_1$, lifts the tray 34 from the altitude $Z_1$ to altitude $Z_2$, as indicated in the plot $Z_{34}$, and concurrently lifts the tray 36 to the altitude $Z_1$ for receiving packages. In sequence the pulses having numbers 10, 12 and 14 still shift the truck 10 from $Y_1$ to $Y_4$ position until the pulse number 16 returns it to the $Y_1$ position. At this pulse the position $Z_{34}$ of the tray 34 goes to altitude $Z_3$, the position $Z_{36}$ of the tray 36 goes to altitude $Z_2$ and the position $Z_{38}$ of the tray 38 goes to altitude $Z_1$ for receiving packages. The first package of each row is advanced to the origin of the X-axis by a method known by one of ordinary skill in the art.

The pulses having a number from 16 to 24 indicate the loading of the last tray 38 and when said last pulse number 24 comes in, the truck is considered completely loaded and said pulse, instead of actuating further truck or tray movement, emits completely loaded truck signals by means of optical and/or acustical signals and release the truck 10 from the machine 12 in such a way that it can be carried to the place where the packages must be delivered.

An electronic circuit capable to execute the functions depicted by FIG. 9 plots and other similar functions, is shown in FIG. 10. Said circuit 170 is comprised by the photodetector 20, already indicated in FIG. 1, signalling a transit into the coveyor 14 of packages forwarded to the truck 10, sending impulse to a squaring amplifier 172 which, at the transit of every package in front of the photodetector 20 emits a rectangular pulse such as the pulses, having numbers 1 to 24 depicted by the plot 20 in FIG. 9.

The output of said squaring amplified 172 is sent to a counter 174 counting the pulses coming from said squaring amplifier and emitting signals representing the total number of said pulses through a plurality of lines 176 connected on a side to a numerical comparator circuit 178 comparing the number coming from the counter 174 with numbers formed on a keyboard 42 and introduced into the comparator 178 through a branch **180*a* of multiple line 180 coming out of said keyboard 42. The numerical data arriving to the comparator 178, through the branch 180*a* of the multiple line 180, presets said comparator 178 to emit signals from the outputs 182–188 controlling through driving amplifiers 190, 192 and 194 the electric motor 62 responsible of the truck movement along the y axis and of the lifting of the trays 34, 36 and 38, an electromagnetic clutch 73 for transmitting movement to the portions 72 or 120 for lifting the trays 34, 36 and 38 when the truck 10 comes back to the origin of the its cartesian axis tern 60 and an unlatching device 196 comprising a ratched wheel 198 stopped in a return movement by a pawl 200 releasable by means of an electromagnet 202, driven by the amplifier 194, which releases the stop to turn back said portion 72 allowing said trays 34, 36 and 38 to descend once their loading has been completed and/or they have been unloaded when the truck 10** comes to the desired place.

Once the desired number of packages, for example 24, according to FIG. 9 plot, as been counted by the counter 174, the comparator 178 emits from the output 188 an alerting and a resetting signal which through an OR gate 204 goes through a line 206 to the counter 174, for resetting it, and to the display 44 for actuating alerting devices such as lights 208 and/or acoustical alarms having the duty to alert an operator that the truck load has been completed. Further, said output line 206 can have a branch 210 to control stops of the machine 12 and/or releases of the truck 10 after a load completion.

When a partial load in the truck or simply the stopping of the same is desired, a branch 212 of the multiple line coming out from the keyboard 42 communicates through a second input of the OR gate 204 whith the output 206 for resetting the counter 174, for alarm in the display 44 and for stopping and/or releasing the truck through the branch 210 stopping the machine 12 and releasing the truck 10 at any time owing to a specific signal introduced through the keyboard 42. The display 44 can be provided with displaying alfa numerical windows, such as the two windows 214 and 216 on which can appear respectively the number of packages counted by the counter 174 and the number of packages to be loaded, preset by the keyboard 42.

The keyboard 42 can be hand controlled by an operator or can be remotly controlled by a central processing unit communicating with the keyboard 42 through a multiple line 218 for supplying truck loading criteria.

What has been here before set forth depictes preferred embodiments of present invention. Thus, they will coming in mind to those skilled in the art, from the reading of present description, partially equivalent changes or variations all intended to be covered by the herebelow appended claims.

While a specific situation is discussed where the packages are only "two deep" in the X-direction in FIG. 8, it is evident that any suitable configuration may be used so that more than two rows of packages are loaded in the X-direction, and more or less than four rows may be loaded in the Y-direction, and more or less than three rows may be loaded in the Z-direction.

I claim:

1. A method for loading an automatic service truck (10) associated with a tern (60) of cartesian axes having an origin in a given point on said truck for moving or carrying paper sheets packages in which a plurality of said packages are arranged side by side and superimposed one above the other according to how many package layers are loaded, comprising the steps of:

(a) supplying and loading along a first direction a first package to a first location on a first plane (34) of said truck, said first package being loaded onto said truck (10) along a first axis (x), then loading a second package along said first axis (x) which pushes the first package to go adjacent to the origin of said tern (60), to fill completely the available space along said first axis (x) on said first plane;

(b) shifting the truck (10) along a second axis (y) perpendicular with respect to the first axis (x) and providing a space large enough to house a second row of packages side by side arranged along said first axis (x) until the available space along the first axis (x) is completely filled, said first axis (x) and said second axis (y) defining said first plane (34);

(c) subsequently shifting the truck (10) along said second axis (y) again for housing on said first plane (34) four rows of packages side by side arranged along said first axis (x);

(d) lifting said first plane (34) along a third axis (z) at the end of the shifting along said second axis (y), said third axis (z) being perpendicular with respect to said first plane (34) defined by said first two axes (x, y), said first plane being lifted along said third axis (z) after being completely filled with packages to make available a second plane (36) onto which is loaded a second group of packages, according to the (a), (b) and (c) steps, until said second plane is completely filled; and (e) lifting said first and second planes (34 and 36) together concurrently along said third axis (z) to make a third plane (38) available to be filled with sheet packages exactly as the first and second planes (34 and 36), said third plane (38) being delimitated by said first and said second axes (x, y), to be filled with a third group of packages according to the procedure used in the steps (a) to (c) for filling said first plane (34), the packaging collection on said truck (10) terminating when said third axis (z) is completely filled.

2. A method for loading an automatic service truck for moving or carrying sheet packages in which a plurality of said packages are arranged side by side and superimposed one above the other according to how many layers are loaded, comprising the steps of:

loading said packages in a side by side relationship onto a truck until a first level on said truck is completely filled with packages, said truck being associated with a tern (60) of cartesian axes intersecting at an origin in a given point on said truck, said packages being loaded onto said truck in said side by side arrangement near a first axis (x) with a first package adjacent to the origin, a second package immediately near the first package, and then a next or third package until the available space along said first axis (x) is completely filled, thus creating a first row of packages;

shifting the truck (10) along a y-axis for housing and filling additional rows of packages arranged side by side adjacent to the second row of packages, thus completely filling said first plane level;

lifting said first level after being completely filed with packages to make available a second level (36) available to receive packages onto which is loaded a second group of packages in a side by side arrangement of packages until said second level is completely filled, and including shifting the truck (10) along said y-axis perpendicular with respect to the x-axis and providing a space large enough to house and fill a second row with packages arranged side by side adjacent to said first row, and then shifting said first level along a third axis (z) after said first level is delimitated by said axes (x) and (y) has been completely filled, said third axis (z) being perpendicular with respect to said first two axes (x, y);

lifting said first level along said third axis (z) parallel with respect to said first two axes (x, y) to make said second level (36) available to be filled with packages according to the procedure used for filling said first level (34); and shifting said truck continuously along said second y-axis until there is space available for a row of side by side arranged packages along said first axis (x), thus completely filling said second level;

lifting said first and second levels together concurrently along said third axis (z) to make a third level (38) available to be filled with sheet packages exactly as the first and second levels (34 and 36) so that all levels are loaded, the package collection on said truck (10) terminating when the space along said third axis (z) is completely filled; and moving said truck from the loading area once all the available levels have been loaded, then stopping the supply of packages once the truck has been completely loaded.

* * * * *